US007777682B2

(12) United States Patent
Yagi

(10) Patent No.: US 7,777,682 B2
(45) Date of Patent: Aug. 17, 2010

(54) PLANE CIRCULAR POLARIZATION ANTENNA AND ELECTRONIC APPARATUS

(75) Inventor: Shigeru Yagi, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 12/011,952

(22) Filed: Jan. 30, 2008

(65) Prior Publication Data

US 2008/0180339 A1 Jul. 31, 2008

(30) Foreign Application Priority Data

Jan. 31, 2007 (JP) ..... 2007-021301

(51) Int. Cl.
*H01Q 21/00* (2006.01)
*H01Q 13/10* (2006.01)

(52) U.S. Cl. ..... 343/725; 343/702; 343/767

(58) Field of Classification Search ..... 343/702, 343/725, 767
See application file for complete search history.

(56) References Cited

U.S. PATENT DOCUMENTS

| | | | | |
|---|---|---|---|---|
| 7,248,224 | B2 | 7/2007 | Yuanzhu | |
| 7,375,686 | B2 * | 5/2008 | Ku et al. | 343/700 MS |
| 7,389,129 | B2 | 6/2008 | Shoji | |
| 2004/0137971 | A1 | 7/2004 | Shoji | |
| 2004/0217916 | A1 * | 11/2004 | Quintero Illera et al. | 343/895 |
| 2005/0200556 | A1 * | 9/2005 | Lin et al. | 343/904 |
| 2006/0001590 | A1 * | 1/2006 | Hung et al. | 343/846 |
| 2006/0132362 | A1 | 6/2006 | Yuanzhu | |
| 2006/0208950 | A1 | 9/2006 | Tago | |
| 2007/0103367 | A1 * | 5/2007 | Wang | 343/700 MS |
| 2007/0268190 | A1 * | 11/2007 | Huynh | 343/702 |

FOREIGN PATENT DOCUMENTS

| | | | |
|---|---|---|---|
| JP | 2004-072605 | A | 3/2004 |
| JP | 2004-159029 | A | 6/2004 |
| JP | 3622959 | B2 | 12/2004 |
| JP | 3656610 | B2 | 3/2005 |
| JP | 2005-286915 | A | 10/2005 |
| JP | 2006-180150 | A | 7/2006 |
| JP | 3830358 | B2 | 7/2006 |
| JP | 2006-529070 | A | 12/2006 |
| WO | WO2004/097980 | A1 | 11/2004 |

OTHER PUBLICATIONS

Japanese Office Action (and English translation thereof) dated Oct. 21, 2008, issued in a counterpart Japanese Application.

* cited by examiner

*Primary Examiner*—Vibol Tan
*Assistant Examiner*—Dylan White
(74) *Attorney, Agent, or Firm*—Frishauf, Holtz, Goodman & Chick, P.C.

(57) ABSTRACT

According to an embodiment, a plane circular polarization antenna comprises a flat insulating substrate and a conductor provided on the flat insulating substrate. The conductor comprises an inverted F antenna including a feeding point, a ground portion, the ground portion including a slot antenna including a slot, and a short-circuiting portion provided in a part of an area between the inverted F antenna and the slot antenna.

8 Claims, 13 Drawing Sheets

PLANE CIRCULAR POLARIZATION ANTENNA AND ELECTRONIC APPARATUS

CROSS-REFERENCE TO RELATED APPLICATIONS

This application is based upon and claims the benefit of priority from prior Japanese Patent Application No. 2007-021301, filed Jan. 31, 2007, the entire contents of which are incorporated herein by reference.

BACKGROUND OF THE INVENTION

1. Field of the Invention

The present invention relates to a plane circular polarization antenna and an electronic apparatus.

2. Description of the Related Art

Conventionally, antennas of portable terminals such as a portable phone and a personal digital assistant (PDA) for wireless communication have been decreased in size. For example, a film antenna is proposed which has an antenna pattern on a planar film and radiates single polarization (for example, Japanese Patent No. 3656610 and Japanese Patent No. 3622959). Also, a film antenna which radiates vertical polarization and horizontal polarization simultaneously is proposed (for example, Japanese Patent No. 3830358). The above film antennas are based on an inverted F antenna having moderate directional characteristics.

A film antenna is also proposed which produces a circular polarization using a modified loop antenna.

The conventional film antenna which radiates single polarization can radiate only single polarization. Thus, when the conventional film antenna is applied to mobile communication (in particular, a portable communication apparatus such as a handy terminal), the mobile communication may become unstable and may be disrupted depending on orientation of the antenna. Therefore, transmitting polarization needs to match receiving polarization.

The conventional film type inverted F plane antenna which radiates vertical and horizontal polarization cannot make phase difference between elements, therefore, it is not possible to radiate circular polarization.

The conventional film antenna which produces circular polarization using the loop antenna is large in shape and is difficult to be mounted to a small portable apparatus. Such film antenna also has a significant directivity. Therefore, depending on the orientation of the antenna, a radio wave cannot be radiated at many angles and communication may be disrupted. Thus, the film antenna is unsuitable for mobile communication between portable apparatuses.

Furthermore, when the film antenna which produces the circular polarization using the loop antenna is mounted close to a ground plane, the antenna comes to deviate from resonance and not to function. Accordingly, a position to which the film antenna is mounted is significantly limited.

BRIEF SUMMARY OF THE INVENTION

An object of the present invention is to provide a plane circular polarization antenna the size of which can be easily reduced and which can be easily mounted to a portable apparatus.

According to one embodiment of the present invention, a plane circular polarization antenna comprises:

a flat insulating substrate; and a conductor provided on the flat insulating substrate, wherein the conductor comprises:

an inverted F antenna including a feeding point;

a ground portion, the ground portion including a slot antenna including a slot, and a short-circuiting portion provided in a part of an area between the inverted F antenna and the slot antenna.

BRIEF DESCRIPTION OF THE SEVERAL VIEWS OF THE DRAWING

The accompanying drawings, which are incorporated in and constitute a part of the specification, illustrate embodiments of the present invention and, together with the general description given above and the detailed description of the embodiments given below, serve to explain the principles of the present invention in which.

DETAILED DESCRIPTION OF THE INVENTION

Embodiments and modifications of the present invention will be described below in detail with reference to the accompanying drawings. It should be noted that the present invention is not limited to the illustrated examples.

An embodiment of the present invention will be described with reference to FIGS. 1 to 9.

Figure 1:
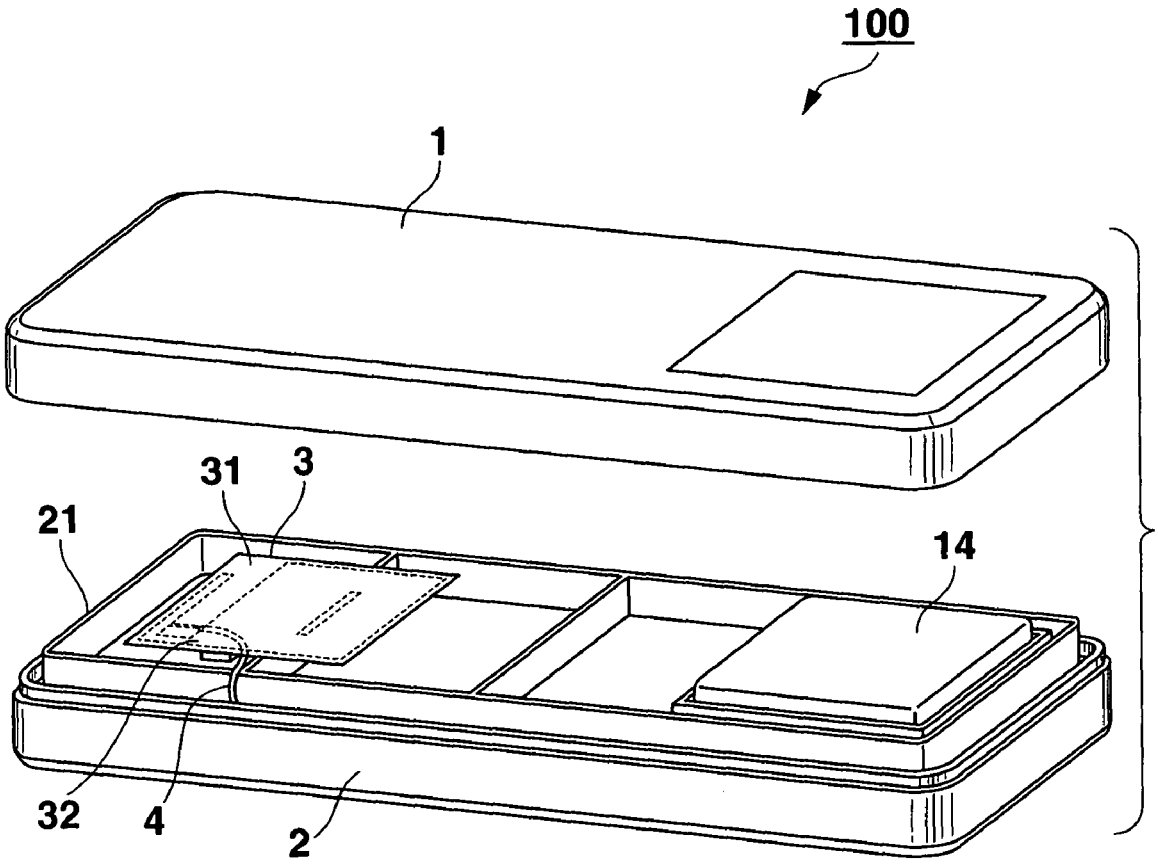
FIG. 1 is a perspective view showing internal configuration of a portable terminal 100 according to an embodiment of the present invention.
Figure 2:
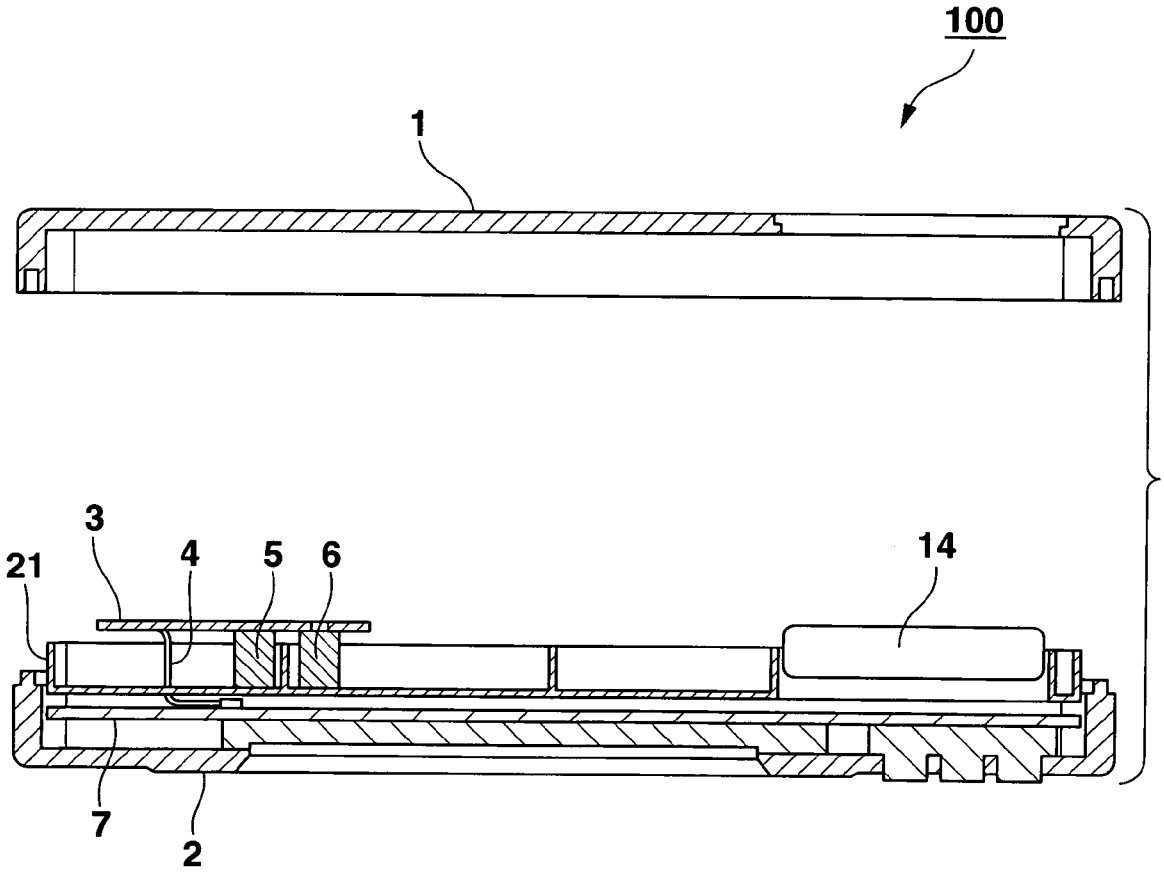
FIG. 2 is a sectional view showing sectional configuration of the portable terminal 100.

First, configuration of an apparatus according to the present embodiment will be described with reference to FIGS. 1 to 6. FIG. 1 is a perspective view showing internal structure of a portable terminal 100 according to the present embodiment. FIG. 1 shows the portable terminal 100 with an upper case 1 detached from the portable terminal 100. FIG. 2 is a sectional view showing sectional configuration of the portable terminal 100 and the detached upper case 1.

The portable terminal 100 which is a portable electronic apparatus according to the present embodiment includes, for example, functions of inputting information in response to user operation and storing the information. In particular, the portable terminal 100 includes a function of wirelessly communicating with external apparatuses via access points by a wireless local area network (LAN).

As shown in FIGS. 1 and 2, the portable terminal 100 comprises the upper case 1, a lower case 2, and between the upper case 1 and the lower case 2, includes a plane circular polarization antenna 3, a coaxial cable 4, a conductive gasket 5 which is a conductive member, a supporter 6 which is dielectric material, a substrate 7, and a display device 14.

The plane circular polarization antenna 3 comprises a base film 31 which is a flat insulating substrate, and a conductor 32 as conduction means. The plane circular polarization antenna 3 is used for wireless LAN communication, and radiates and receives a radio wave. The conductor 32 such as a copper foil is pattern-formed onto the back of the base film 31. The conductor 32 is connected to the substrate 7 via the coaxial cable 4. The base film 31 is formed from insulating material. The plane circular polarization antenna 3 is installed above the lower case 2, and the conductive gasket 5 and the supporter 6 are sandwiched between the plane circular polarization antenna 3 and the lower case 2.

The conductive gasket 5, which has conductivity, supports the plane circular polarization antenna 3 and is connected to a frame ground of a frame 21 of the lower case 2. As the conductive gasket 5, rectangular elastic insulating material, such as rubber sponge, surrounded by a conductor (for example, a wire mesh) is used. The conductive gasket 5 may be replaced by a conductive supporter such as a mass of metal, fibers including carbon fibers, or the like. The supporter 6 supports the plane circular polarization antenna 3 and is made from dielectric material such as rubber.

The portable terminal 100 includes a secondary battery (not shown) and the secondary battery supplies power to portions of the portable terminal 100. Antenna current generated by the substrate 7 is supplied to the conductor 32 through the coaxial cable 4, and the conductor 32 radiates a radio wave. When the plane circular polarization antenna 3 receives a radio wave, internal current is entered to the substrate 7 from the conductor 32 through the coaxial cable 4.

Figure 3:
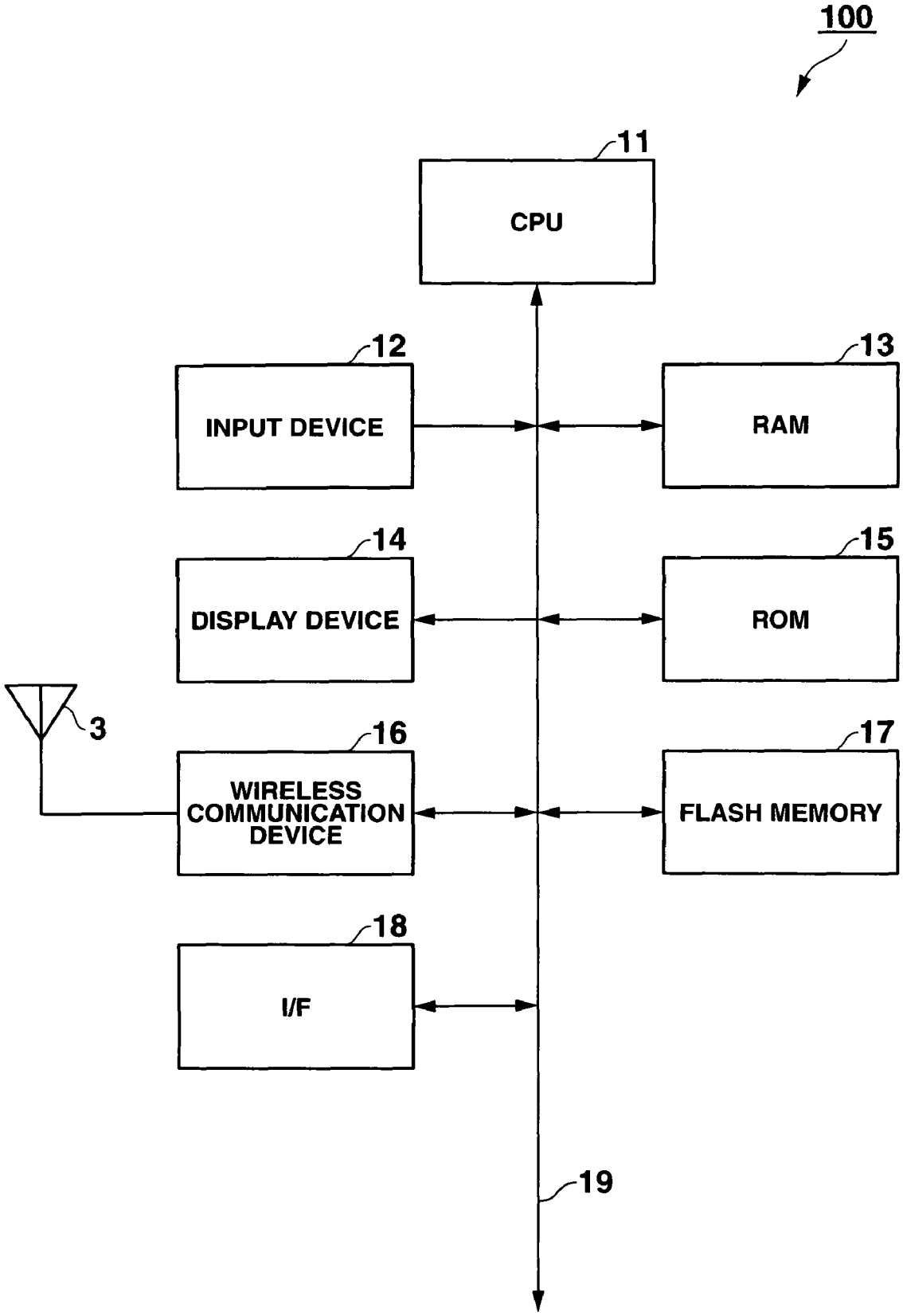
FIG. 3 is a block diagram showing internal configuration of the portable terminal 100.

FIG. 3 is a block diagram showing internal configuration of the portable terminal 100. As shown in FIG. 3, the portable terminal 100 comprises a central processing unit (CPU) 11, an input device 12, a random access memory (RAM) 13, a display device 14, a read-only memory (ROM) 15, a wireless communication device 16 which is connected to the plane circular polarization antenna 3, a flash memory 17, and an interface 18. These portions are connected together via a bus 19.

The CPU 11 centrally controls components of the portable terminal 100. The CPU 11 expands into the RAM 13 a program designated from a system program and various application programs stored in the ROM 15. The CPU 11 cooperates with the expanded program to execute a variety of processing.

The CPU 11 cooperates with the various programs to receive input of operation information from the input device 12, to read a variety of information from the ROM 15, to write and read a variety of information to and from the flash memory 17, to communicate wirelessly with an external apparatus by means of the wireless communication device 16, and to make wired communication with an external apparatus via the interface 18.

The input device 12 receives operation input information which is input with a finger, a touch pen, or the like and outputs the information to the CPU 11. The input device 12 and the display device 14 are integrally formed as a touch panel. The input device 12 may include a key pad comprising a cursor key, numeral input keys, various function keys, and the like and output operation input information to the CPU 11 in response to depression of each key by an operator.

The RAM 13 is a nonvolatile memory and temporarily stores information. The RAM 13 includes a work area in which various programs to be executed and data related to the programs are stored. The display device 14 includes a liquid crystal display (LCD), an electro luminescent display (LED), or the like to display various information in accordance with display signals from the CPU 11.

The ROM 15 is a read-only storage that stores information of a variety of programs and data.

The wireless communication device 16 is connected to the plane circular polarization antenna 3. The wireless communication device 16 transmits and receives information to and from an external apparatus by the plane circular polarization antenna 3 via access point in wireless LAN communication. In the present embodiment, a case in which frequency band of wireless LAN communication is 2.45 GHz band will be described. However, the present invention is not limited to this. The frequency band of the wireless LAN communication may be 5.2 GHz band, or any other frequency band. Moreover, another method of wireless communication may be employed.

The flash memory 17 is a storage to and from which information such as a variety of data can be written and read. The interface 18 transmits and receives information to and from an external apparatus via a communication cable. The interface 18 is a wired communication device based on, for example, a universal serial bus (USB) method.

Figure 4:
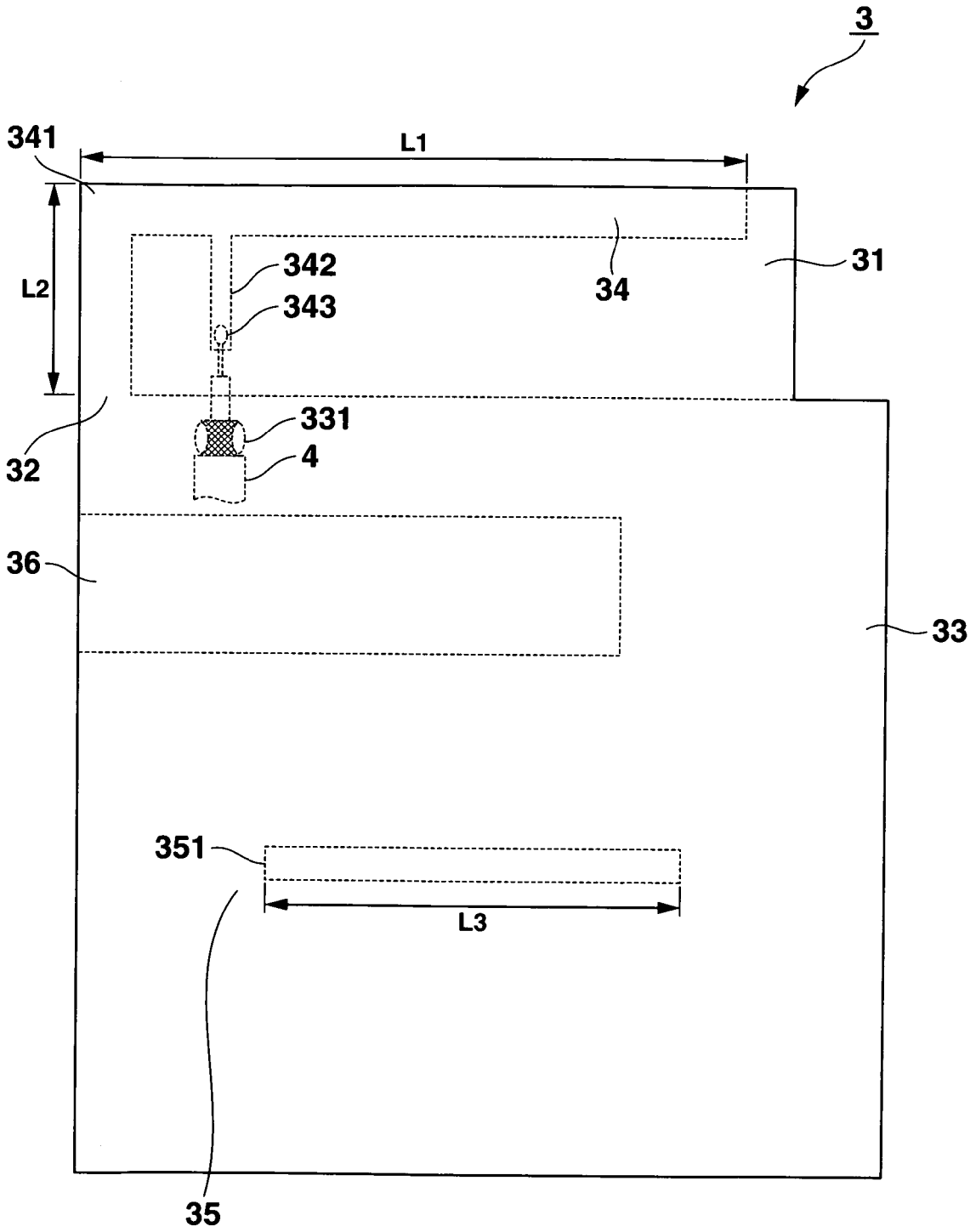
FIG. 4 is a plan view showing configuration of a plane circular polarization antenna 3.
Figure 5:
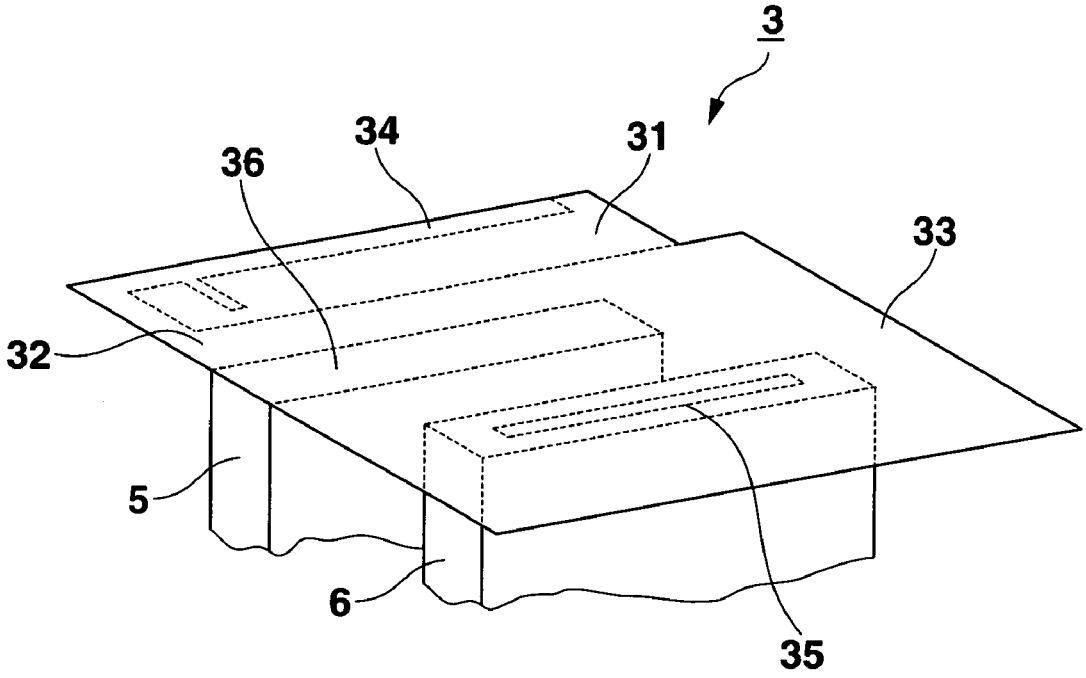
FIG. 5 is a perspective view showing the configuration of the plane circular polarization antenna 3.
Figure 6:
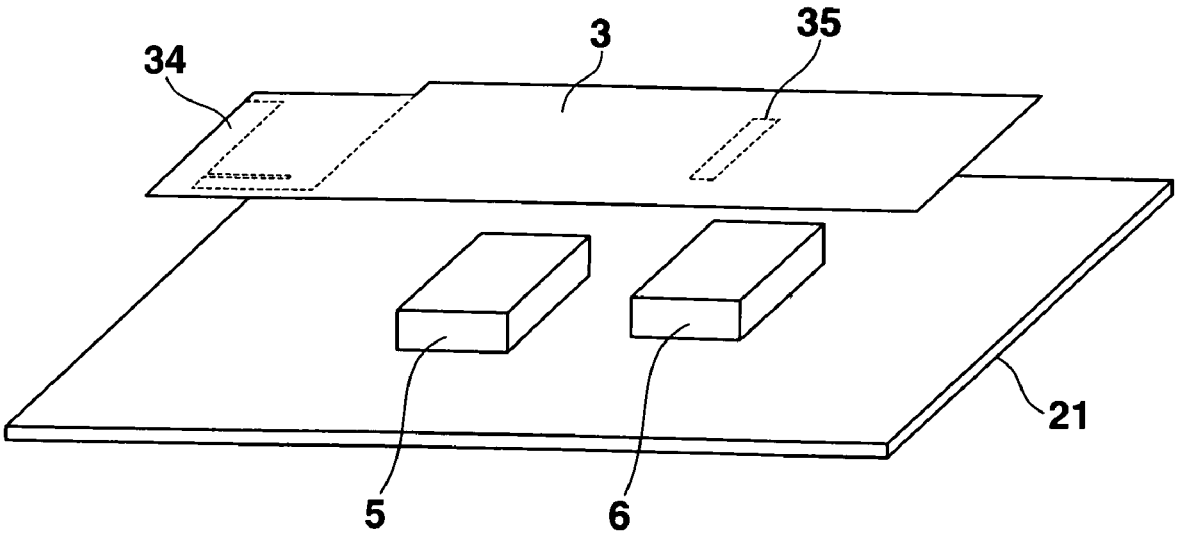
FIG. 6 is a view showing how the plane circular polarization antenna 3 is mounted on a frame 21.

Next, configuration of the plane circular polarization antenna 3 will be described with reference to FIGS. 4 to 6. FIG. 4 is a plan view showing planar configuration of the plane circular polarization antenna 3. FIG. 5 is a perspective view showing perspective configuration of the plane circular polarization antenna 3. FIG. 6 is a perspective view showing how the plane circular polarization antenna 3 is attached to the frame 21.

As shown in FIG. 4, a predetermined pattern is formed by cutting or the like on the conductor 32 which is back of the base film 31. The conductor 32 includes a rectangular ground plane 33 as ground means and an inverted F antenna 34 as inverted F antenna means on the same plane. The ground plane 33 includes a slot antenna (slit antenna) 35 as slot antenna means and ground short portion 36 as short-circuiting means.

The inverted F antenna 34 is an inverted-F-shaped antenna. The inverted F antenna 34 comprises an L-shaped portion 341 and projection 342 connected to a longer side of the L-shaped portion 341. On the projection 342, core wire of the coaxial cable 4 is connected to a connection point 343 by soldering or the like.

On the ground plane 33, a ground wire (mesh of conductive wire) of the coaxial cable 4 is connected to a connection point 331 by soldering or the like. In the inverted F antenna 34, internal current flows through a loop including the connection point 343, the projection 342, a part of the L-shaped portion 341, and the connection point 331, and a horizontally polarized wave is radiated. When the inverted F antenna 34 receives a horizontally polarized wave, internal current flows through the loop including the connection point 343, the projection 342, a part of the L-shaped portion 341, and the connection point 331.

Lengths of a long side and a short side of the L-shaped portion 341 are defined by L1 and L2, respectively. One-forth of wavelength of a radio wave with which the inverted F antenna 34 resonates is equal to (L1+L2). Therefore, the inverted F antenna 34 is configured, for wireless communication, to radiate or receive a radio wave of such a frequency band that one-forth of the wavelength matches (L1+L2).

The length of each side of the ground plane 33 is set to be longer than one-fourth of the wavelength of the radio wave of the frequency band radiated or received for the wireless LAN communication. The ground plane 33 includes a rectangular slot 351, and a slot antenna 35 including the slot 351 is configured. Directions of current along upper and lower longitudinal sides of the slot 351 are opposite to each other. Internal current flows around periphery of the slot 351, voltage is generated between the upper and lower sides of the slot 351 (in a latitudinal direction), and a vertically polarized radio wave is produced. When the slot antenna 35 receives a vertically polarized radio wave, internal current flows around the periphery of the slot 351.

As shown in FIGS. 5 and 6, the plane circular polarization antenna 3 is provided above the frame 21, and the conductive gasket 5 and the supporter 6 are sandwiched between the plane circular polarization antenna 3 and the frame 21. Length of long side of the slot 351 is defined by L3. The slot antenna 35 is designed to resonate with such a radio wave that one-fourth of wavelength of the radio wave is equal to L3.

The supporter 6 is attached to the back of the slot antenna 35 so as to cover entirely one surface of the slot 351. Thus, the longitudinal length of the slot 351 is further reduced depending on a dielectric constant of the supporter 6. With respect to wavelength of an objective frequency, the effect of the reduction in the length of the slot 351 due to the dielectric constant of the supporter 6 is expressed by expression (1).

$$1/(\in_{eff})^{1/2} \quad (1)$$

The supporter 6 of the present embodiment is made of rubber and has a dielectric factor $\in_{eff}$ of about 4. Therefore, the value of the expression (1) becomes about 0.5, and the longitudinal length of the slot 351 can be reduced to about half. However, the material of the supporter 6 is not limited to rubber. For example, in a case in which the material of the supporter 6 is ceramic, a dielectric constant $\in_{eff}$ of the supporter 6 is about 90. In this case, the value of the expression (1) is 0.1054, and the length L3 of the slot 351 can be reduced to about one-tenth.

The ground short portion 36 is provided at a partial area between the inverted F antenna 34 and the slot antenna 35. The frame 21 of the lower case 2 functions as a frame ground. Thus, the ground short portion 36 is short-circuited to the frame ground of the frame 21 via the conductive gasket 5. Accordingly, no internal current flows through the ground short portion 36. Therefore, between the inverted F antenna 34 and the slot antenna 35, the internal current flows through an area on the ground plane 33 bypassing the ground short portion 36. This results in a phase difference between the current flowing through the inverted F antenna 34 and the current flowing through the slot antenna 35. The position and length of the ground short portion 36 are set so that the current flowing through the inverted F antenna 34 comes to be experimentally appropriate.

Figure 7A:
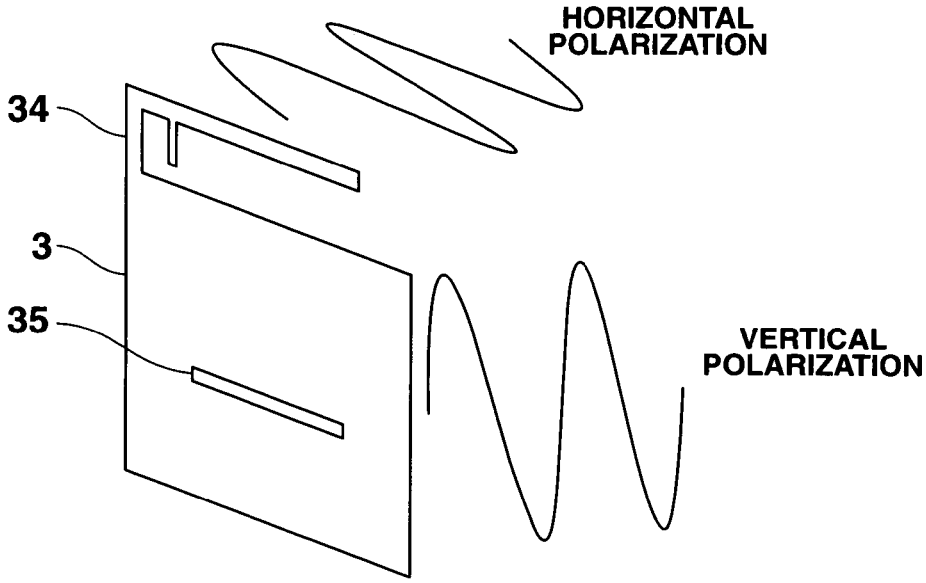
FIG. 7A is a view showing radio waves radiated from an inverted F antenna 34 and a slot antenna 35.
Figure 7B:
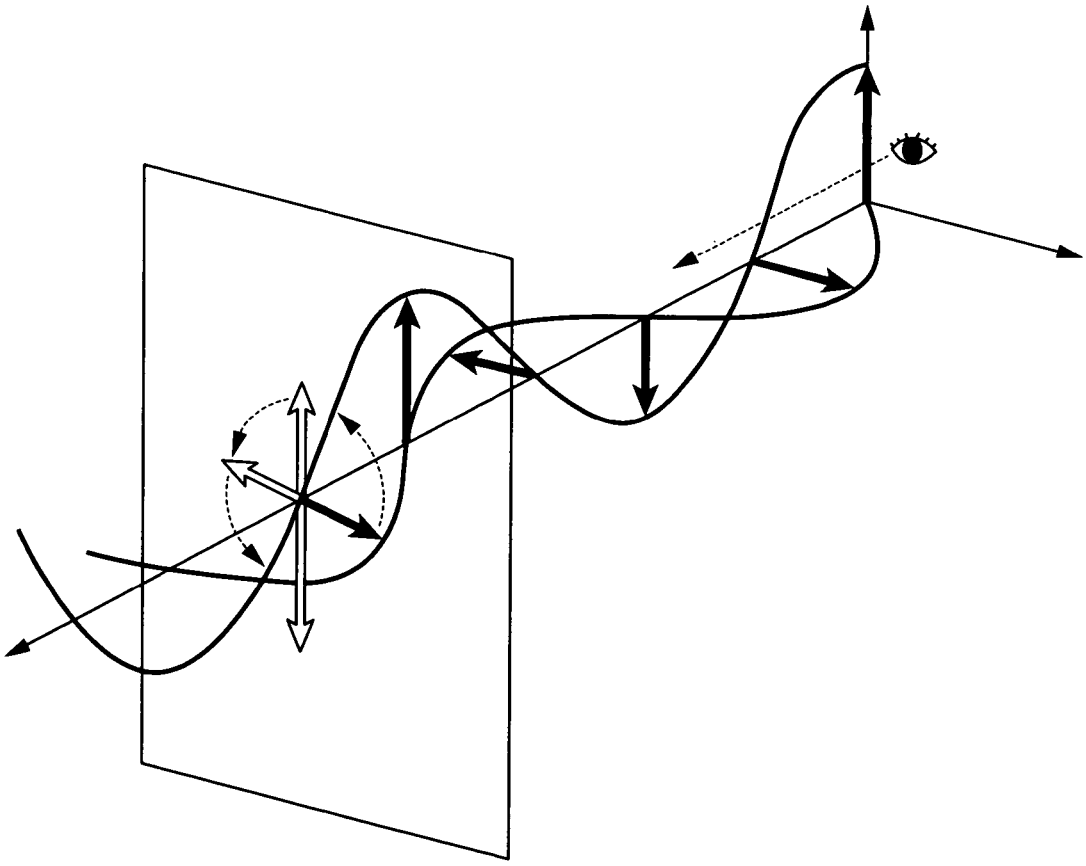
FIG. 7B is a diagram showing composition of vertical polarization and horizontal polarization.

Subsequently, a radio wave radiated by the plane circular polarization antenna 3 will be described with reference to FIGS. 7A and 7B. FIG. 7A is a view showing radio waves radiated from the inverted F antenna 34 and the slot antenna 35. FIG. 7B is a view showing composition of vertical polarization and horizontal polarization.

As shown in FIG. 7A, in a case in which the longitudinal direction of the inverted F antenna 34 is defined as a lateral direction, the inverted F antenna 34 in the plane circular polarization antenna 3 radiates a horizontally polarized radio wave. Similarly, the slot antenna 35 radiates a vertically polarized radio wave. There is a phase difference between the horizontal polarization and the vertical polarization.

As shown in FIG. 7B, the horizontal polarization and the vertical polarization radiated from the plane circular polarization antenna 3 are combined to be circular polarization. Therefore, it is not required to match a polarization plane of the plane circular polarization antenna 3 with one of the horizontal polarization and the vertical polarization in accordance with the direction of an access point, in order to improve radiation efficiency (reception sensitivity of the access point). The directivity of the plane circular polarization antenna 3 is thus improved.

With regard to the reception of a radio wave by the plane circular polarization antenna 3, the reception sensitivity for a single-polarization radio wave can be stabilized regardless of the direction of the polarization. The plane circular polarization antenna 3 can also receive a circularly polarized radio wave.

Figure 8A:
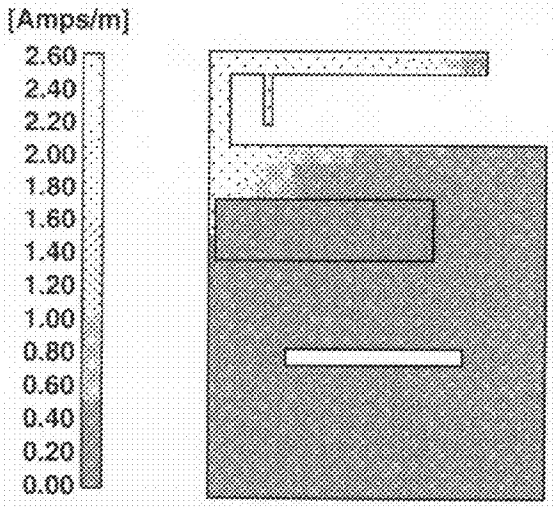
FIG. 8A is a view showing distribution of current flowing through the plane circular polarization antenna 3 in a first state.
Figure 8B:
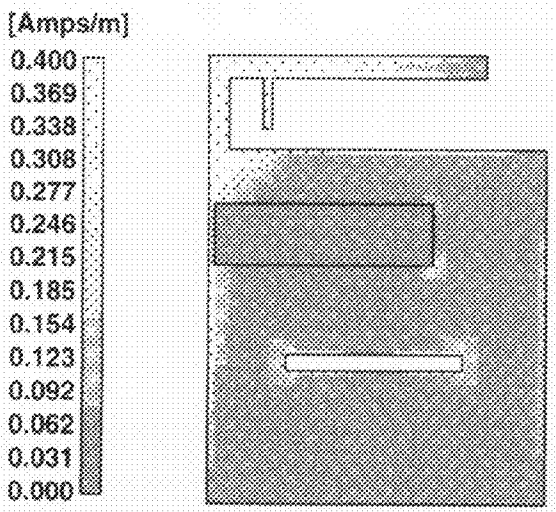
FIG. 8B is a view showing distribution of current flowing through the plane circular polarization antenna 3 in a second state.
Figure 8C:
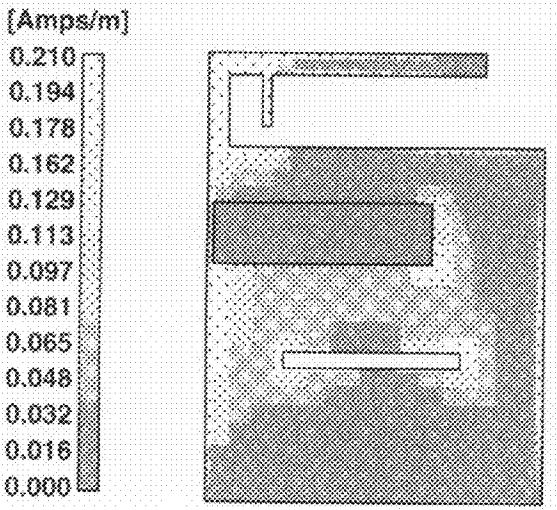
FIG. 8C is a view showing distribution of current flowing through the plane circular polarization antenna 3 in a third state.
Figure 8D:
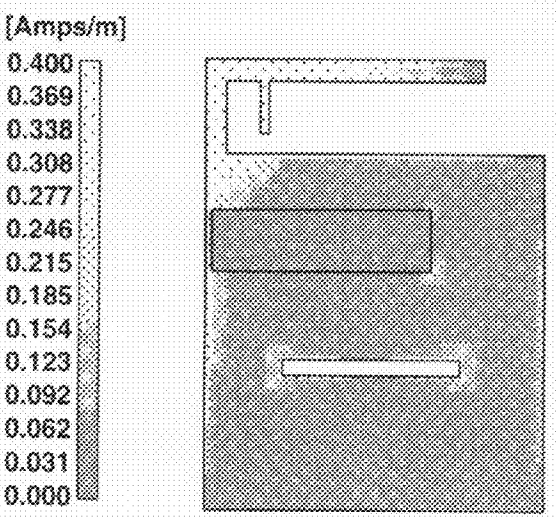
FIG. 8D is a view showing distribution of current flowing through the plane circular polarization antenna 3 in a fourth state.

Subsequently, with reference to FIGS. 8A to 8D, description will be given of distribution of the internal current flowing through the plane circular polarization antenna 3 during radio wave radiation. FIG. 8A is a view showing distribution of the current flowing through the plane circular polarization antenna 3 in a first state. FIG. 8B is a view showing distribution of the current flowing through the plane circular polarization antenna 3 in a second state. FIG. 8C is a view showing distribution of the current flowing through the plane circular polarization antenna 3 in a third state. FIG. 8D is a view showing distribution of the current flowing through the plane circular polarization antenna 3 in a fourth state.

In FIGS. 8A to 8D, density of dots corresponds to largeness of the amount of current per unit length. The unit of numerical values in FIGS. 8A to 8D is [Amps/m]. Current fed to the plane circular polarization antenna 3 via the coaxial cable 4 includes periodicity owing to phase feeding. Thus, the internal current of the plane circular polarization antenna 3 at the time of radio wave radiation shifts periodically as follows: the first state of FIG. 8A→the second state of FIG. 8B→the third state of FIG. 8C→the fourth state of FIG. 8D→the first state of FIG. 8A . . . . Since the ground short portion 36 is short-circuited to the ground, no current flows through the ground short portion 36.

In the first state of FIG. 8A, phase feeding from a feeding point in the plane circular polarization antenna 3 allows the maximum current to flow through the inverted F antenna 34. Consequently, the inverted F antenna 34 starts radiating a radio wave. The current flowing through the inverted F antenna 34 stops at the ground short portion 36 and does not spread (flow) to another portion. Thus, no current flows through the slot antenna 35, which radiates almost no radio wave.

In the second state of FIG. 8B, a phase of the phase feeding is advanced. Accompanied by decrease of current flowing through the inverted F antenna 34, current of opposite phase due to induction starts flowing around the periphery of the slot 351 of the slot antenna 35. At this time, the inverted F antenna 34 and the slot antenna 35 radiate weak radio waves of the opposite phase.

In the third state of FIG. 8C, current flowing through the inverted F antenna 34 becomes minimal, while current of the opposite phase due to induction flowing through the slot antenna 35 becomes maximal. Thus, the slot antenna 35 radiates a maximum radio wave. The inverted F antenna 34 radiates almost no radio wave.

In the second state of FIG. 8D, the phase of the phase feeding is advanced, and decrease of current flowing through the slot antenna 35 is accompanied by increase of current flowing through the inverted F antenna 34. At this time, the inverted F antenna 34 and the slot antenna 35 radiate weak radio waves of the opposite phase. The variations in current distribution of the first to fourth states causes the plane circular polarization antenna 3 to radiate horizontal polarization and vertical polarization having different phases from each other. Combination of the horizontal polarization and the vertical polarization results in a twisting change, and radiation circular polarization shown in FIG. 7B can be achieved.

Figure 9:
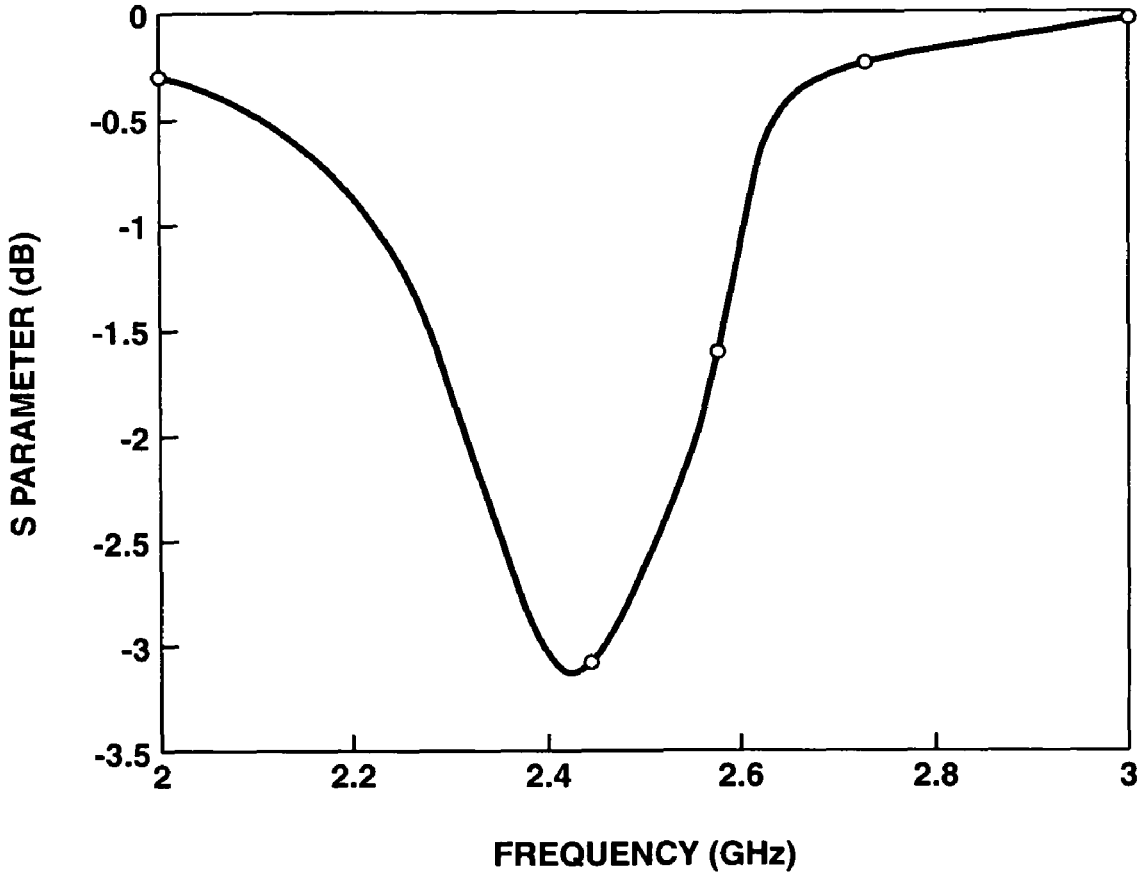
FIG. 9 is a view showing characteristics of an S parameter of the plane circular polarization antenna 3 with respect to frequencies.

FIG. 9 is a diagram showing characteristics of S parameter (scattering parameter) [dB] with respect to a frequency of 2.45 GHz of the plane circular polarization antenna 3. FIG. 9 shows that the plane circular polarization antenna 3 has the lowest S parameter [dB] at a frequency band of 2.45 GHz. It can be noted that the plane circular polarization antenna 3 matches a frequency band of 2.45 GHz which is a frequency band of wireless LAN communication.

As described above, the ground short portion 36 is provided between the inverted F antenna 34 and slot antenna 35 of the plane circular polarization antenna 3, in the present embodiment. Consequently, current having phase difference from the current fed to the inverted F antenna 34 can be readily provided. The current having phase difference flows through the slot antenna 35 to allow the inverted F antenna 34 to radiate horizontal polarization and the slot antenna 35 to radiate vertical polarization. Combination of the horizontal polarization and the vertical polarization causes radiation of circular polarization.

The ground short portion 36 and the slot antenna 35 are provided on the ground plane 33. Therefore, the plane circular polarization antenna 3 can be downsized.

Attaching the dielectric supporter 6 to one surface of the rectangular slot 351 in the slot antenna 35 shortens the length of the slot 351 and thus the plane circular polarization antenna 3 can be downsized. Furthermore, the slot 351 is in the shape of a simple rectangle. Accordingly, the slot 351 can be easily formed.

The plane circular polarization antenna 3 is configured in consideration of one-fourth of wavelength of a radio wave which the plane circular polarization antenna radiates or receives. Length of one side of the ground plane 33 is set to be longer than one-fourth of the wavelength of the radio wave. Thus, the plane circular polarization antenna 3 can be easily constructed and miniaturized.

The ground short portion 36 is short-circuited to the frame ground of the frame 21 of the lower case 2 via the conductive gasket 5. Therefore, the plane circular polarization antenna 3 can be mounted closer to the frame position, and limitation on mounting position can be relaxed.

The plane circular polarization antenna 3 can be easily mounted to the portable terminal 100, which is a portable small-sized electronic apparatus.

The present invention is not limited to the above embodiment. The embodiment can be modified in various manner.

First Modification

Figure 10:
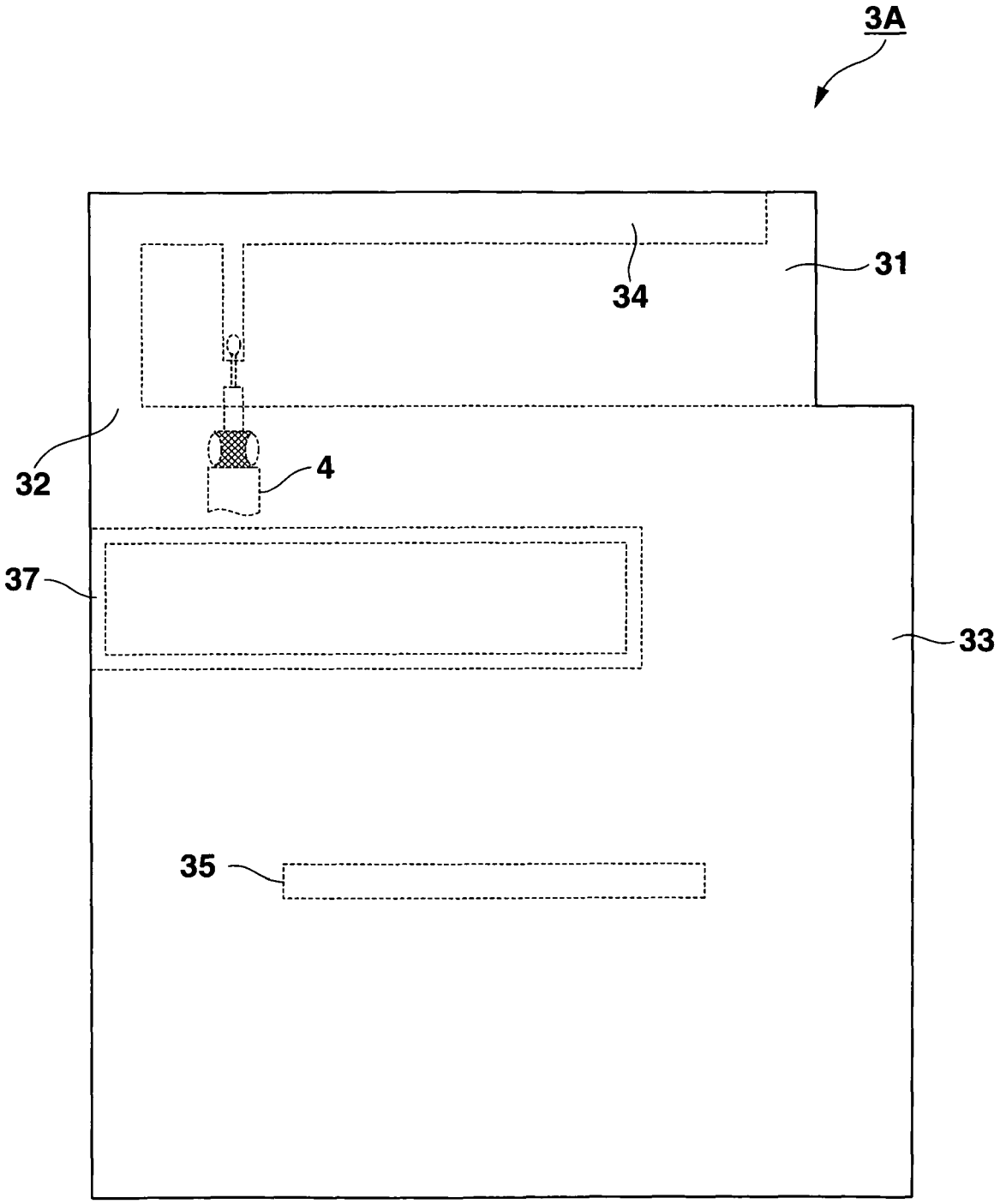
FIG. 10 is a plan view showing configuration of a plane circular polarization antenna 3A.

A first modification of the above embodiment will be described with reference to FIG. 10. FIG. 10 is a plan view showing planar configuration of a plane circular polarization antenna 3A.

As shown in FIG. 10, the plane circular polarization antenna 3A of the present modification includes a ground short portion 37 instead of the ground short portion 36 of the above plane circular polarization antenna 3. The conductive gasket (not shown) of the present modification is in the shape of a rectangular cylinder, and the ground short portion 37 is correspondingly in the shape of a cross section of a rectangular cylinder.

According to the plane circular polarization antenna 3A of the present variation, effects similar to the above-described embodiment is realized and weight of the ground short portion 37 can be saved.

Second Modification

Figure 11A:
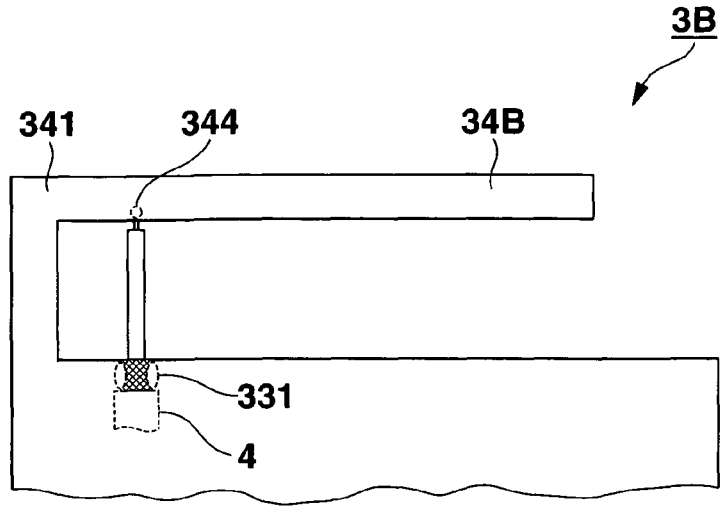
FIG. 11A is a plan view showing partial configuration of a plane circular polarization antenna 3B.
Figure 11B:
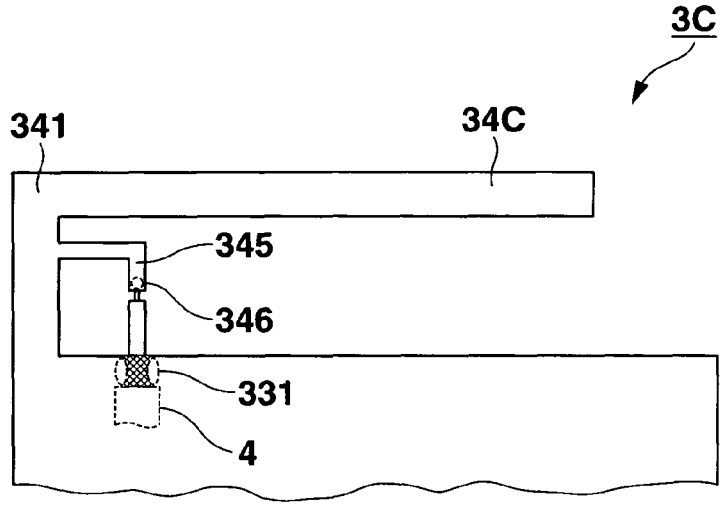
FIG. 11B is a plan view showing partial configuration of a plane circular polarization antenna 3C.
Figure 11C:
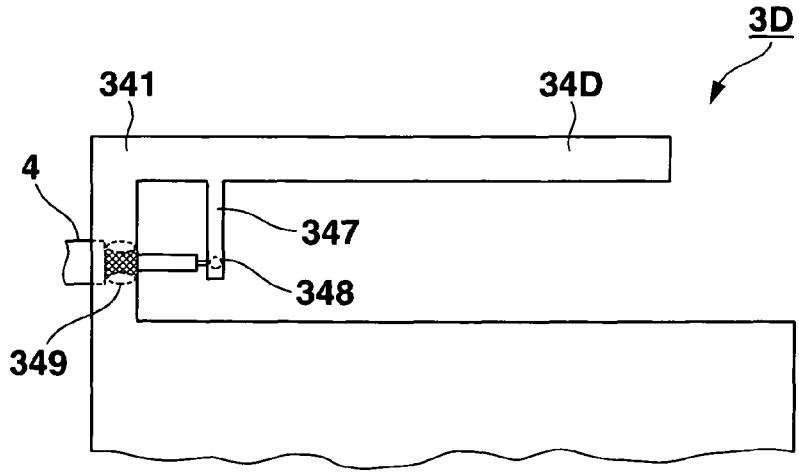
FIG. 11C is a plan view showing partial configuration of a plane circular polarization antenna 3D.

A second modification of the above embodiment will be described with reference to FIGS. 11A to 11C. FIG. 11A is a plan view showing a part of planar configuration of a plane circular polarization antenna 3B. FIG. 11B is a plan view showing a part of planar configuration of a plane circular polarization antenna 3C. FIG. 11C is a plan view showing a part of planar configuration of a plane circular polarization antenna 3D.

The plane circular polarization antennas 3B, 3C, and 3D of the present modification are obtained by changing the feeding position of the coaxial cable 4 in the plane circular polarization antenna 3 of the above embodiment. In FIGS. 11A to 11C, the base film 31 is omitted to simplify the figures.

As shown in FIG. 11A, the plane circular polarization antenna 3B of the present modification includes an inverted F antenna 34B instead of the inverted F antenna 34 of the plane circular polarization antenna 3 described in the above embodiment. The inverted F antenna 34B comprises only the L-shaped portion 341. On the L-shaped portion 341, core of the coaxial cable 4 is connected to a connection point 344 by soldering or the like. On the ground plane 33, ground wire of the coaxial cable 4 is connected to the connection point 331 by soldering or the like. At the time of radiation or reception of a radio wave, internal current flows through a loop including the connection point 344, a part of the L-shaped portion 341, and the connection point 331. The loop length is the same as the loop length of the inverted F antenna 34 of the plane circular polarization antenna 3.

As shown in FIG. 11B, the plane circular polarization antenna 3C of the present modification includes an inverted F antenna 34C instead of the inverted F antenna 34 of the plane circular polarization antenna 3 described in the above embodiment. The inverted F antenna 34C comprises the L-shaped portion 341 and a projection 345 connected to a shorter side of the L-shaped portion 341. On the projection 345, the core of the coaxial cable 4 is connected to a connection point 346 by soldering or the like. On the ground plane 33, the ground wire of the coaxial cable 4 is connected to the connection point 331 by soldering or the like. At the time of radiating or receiving a radio wave, internal current flows through a loop including the connection point 346, the projection 345, a part of the L-shaped portion 341, and the connection point 331. The loop length is the same as the loop length of the inverted F antenna 34 of the plane circular polarization antenna 3.

As shown in FIG. 11C, the plane circular polarization antenna 3D of the present modification includes an inverted F antenna 34D instead of the inverted F antenna 34 of the plane circular polarization antenna 3 described in the above embodiment. The inverted F antenna 34D comprises the L-shaped portion 341 and a projection 347 connected to a longer side of the L-shaped portion 341. On the projection 347, the core of the coaxial cable 4 is connected to a connection point 348 by soldering or the like. On the L-shaped portion 341, the ground wire of the coaxial cable 4 is connected to a connection point 349 by soldering or the like. At the time of radiating or receiving a radio wave, internal current flows through a loop including the connection point 348, the projection 347, a part of the L-shaped portion 341, and the connection point 349. The loop length is the same as the loop length of the inverted F antenna 34 of the plane circular polarization antenna 3.

As described above, the plane circular polarization antennas 3B to 3D of the second modification produces similar effects to the above embodiment. Moreover, the feeding point can be appropriately set in accordance with an embodiment to be implemented.

Third Modification

Figure 12A:
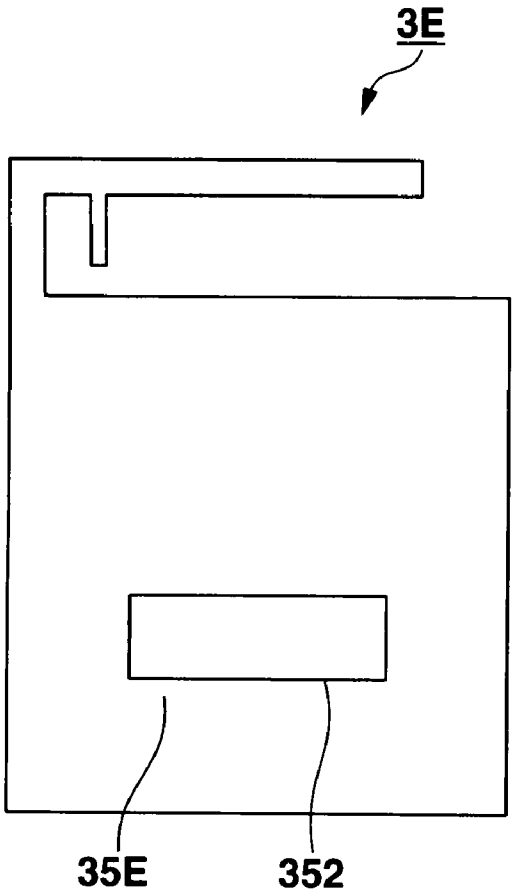
FIG. 12A is a schematic plan view showing partial configuration of a plane circular polarization antenna 3E.
Figure 12B:
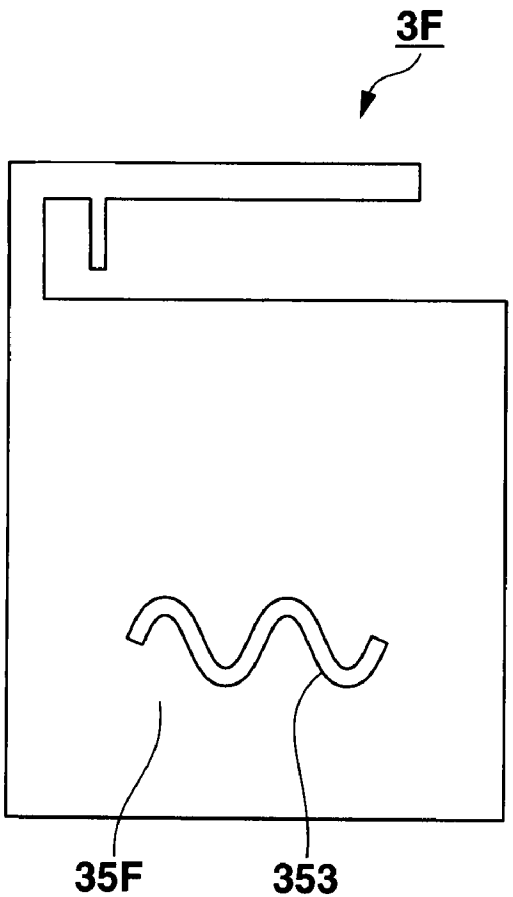
FIG. 12B is a schematic plan view showing partial configuration of a plane circular polarization antenna 3F.
Figure 12C:
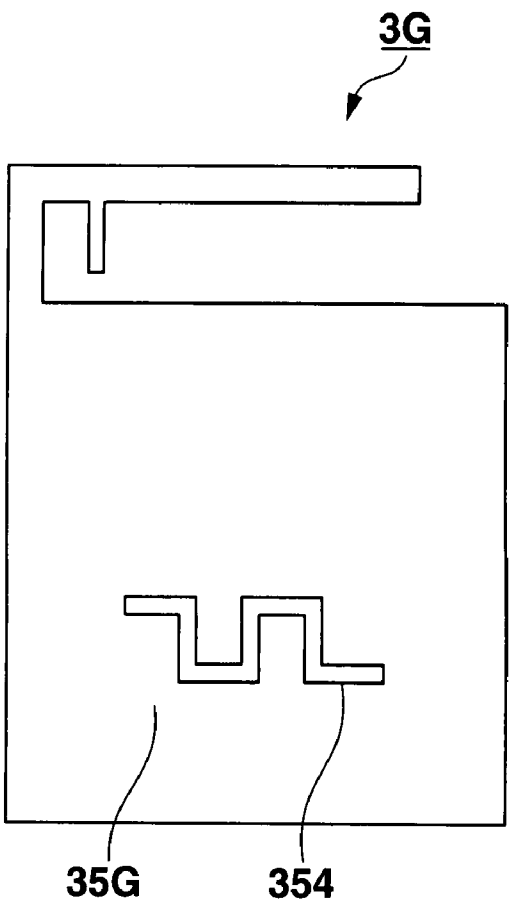
FIG. 12C is a schematic plan view showing partial configuration of a plane circular polarization antenna 3G.

A third modification of the above embodiment will be described with reference to FIGS. 12A to 12C. FIG. 12A is a plan view showing schematic planar configuration of a plane circular polarization antenna 3E. FIG. 12B is a plan view showing schematic planar configuration of a plane circular polarization antenna 3F. FIG. 12C is a plan view showing schematic planar configuration of a plane circular polarization antenna 3G.

The plane circular polarization antennas 3E to 3G of the present modification are obtained by changing the shape of the slot antenna 35 of the plane circular polarization antenna 3 described in the above embodiment. In FIGS. 12A to 12C, the base film 31 is omitted to simplify the figures.

As shown in FIG. 12A, the plane circular polarization antenna 3E of the present modification includes a slot antenna 35E instead of the slot antenna 35 of the plane circular polarization antenna 3 described in the above embodiment. The slot antenna 35E comprises a slot 352. The slot 352 is longer in the latitudinal direction than the slot 351 of the above embodiment. It is preferable that aspect ratio of the slot 352 is arbitrarily changed so that antenna characteristics become experimentally appropriate.

As shown in FIG. 12B, the plane circular polarization antenna 3F of the present modification includes a slot antenna 35F instead of the slot antenna 35 of the plane circular polarization antenna 3 described in the above embodiment. The slot antenna 35F comprises a slot 353. The slot 353 is corrugated and can have a longer peripheral length than the rectangular slot even though the same area is used. The number of waves in the corrugation is at least one.

As shown in FIG. 12C, the plane circular polarization antenna 3G of the present modification includes a slot antenna 35G instead of the slot antenna 35 of the plane circular polarization antenna 3 described in the above embodiment. The slot antenna 35G comprises a slot 354. The slot 354 is crank-shaped and can have a longer peripheral length than the rectangular slot even though the same area is used.

As described above, the plane circular polarization antennas 3E to 3G of the third modification produces similar effects to the above embodiment. Moreover, the slots can be appropriately shaped. According to the plane circular polarization antenna 3E, the slot is readily formed. According to the plane circular polarization antennas 3F and 3G, the length of the slots can be easily lengthened and further downsizing can be achieved.

Fourth Modification

Figure 13A:
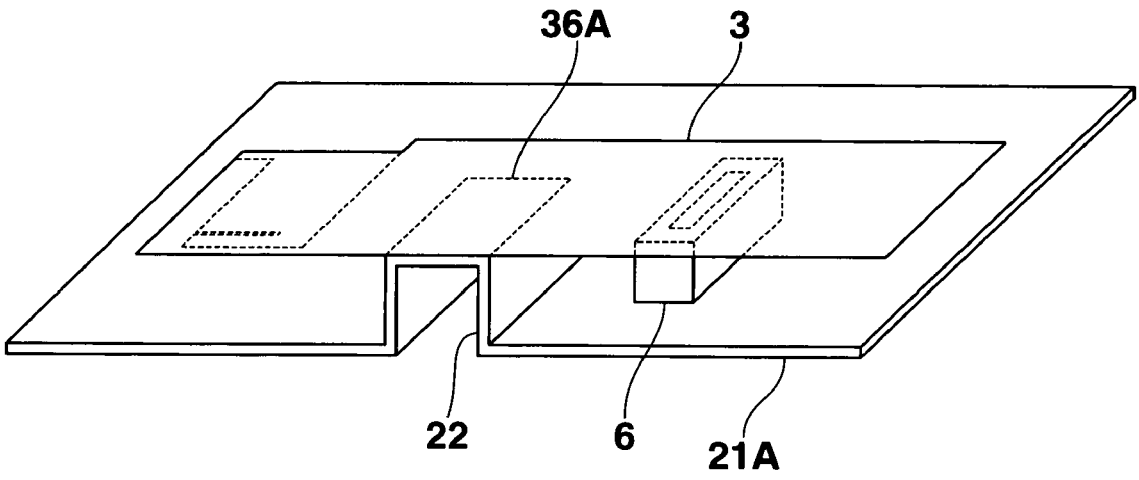
FIG. 13A is a perspective view showing configuration of a frame 21A on which the plane circular polarization antenna 3 is mounted.
Figure 13B:
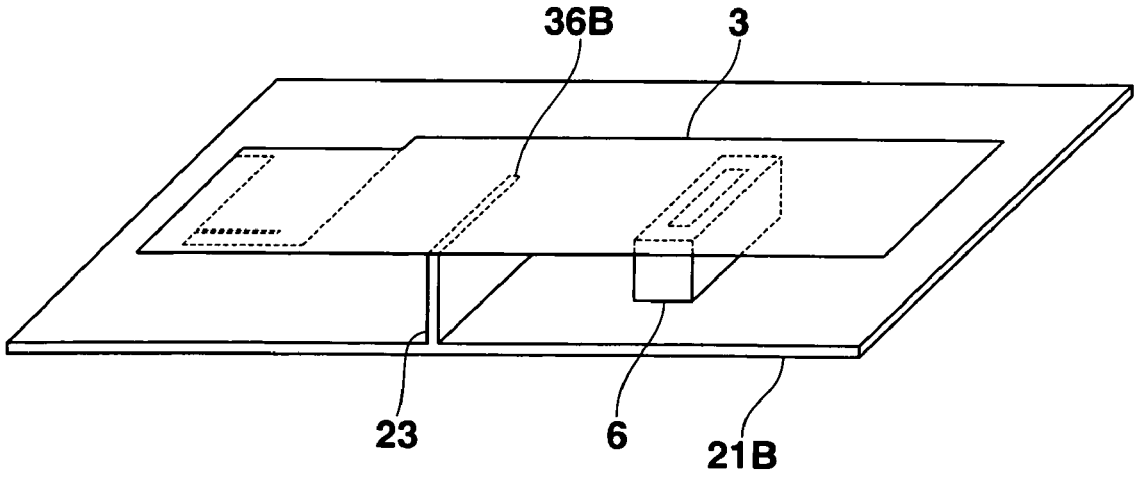
FIG. 13B is a perspective view showing configuration of a frame 21B on which the plane circular polarization antenna 3 is mounted.

A fourth modification of the above embodiment will be described with reference to FIGS. 13A and 13B. FIG. 13A is a perspective view showing perspective configuration of a frame 21A on which the plane circular polarization antenna 3 is mounted. FIG. 13B is a perspective view showing perspective configuration of a frame 21B on which the plane circular polarization antenna 3 is mounted.

The frames 21A and 21B in the present modification are obtained by changing the shape of the frame 21 of the lower case 2 of the plane circular polarization antenna 3 described in the above embodiment.

As shown in FIG. 13A, the frame 21A of the lower case of the present modification comprises a spacer 22. The plane circular polarization antenna 3 is installed on the spacer 22. The ground plane 33 of the plane circular polarization antenna 3 includes a ground short portion 36A corresponding to the spacer 22. The frame 21A functions as a frame ground. Thus, the spacer 22 itself serves as a frame ground for the frame 21A.

As shown in FIG. 13B, the frame 21B of the lower case of the present modification comprises a rib 23. The plane circular polarization antenna 3 is installed on the rib 23. The ground plane 33 of the plane circular polarization antenna 3 includes a ground short portion 36B corresponding to the rib 23. The frame 21B functions as a frame ground. Thus, the rib 23 itself serves as a frame ground for the frame 21B.

As described above, the fourth modification produces similar effects to the above embodiment. Moreover, the plane circular polarization antenna 3 can be easily mounted to a position close to the frame.

Fifth Modification

Figure 14:
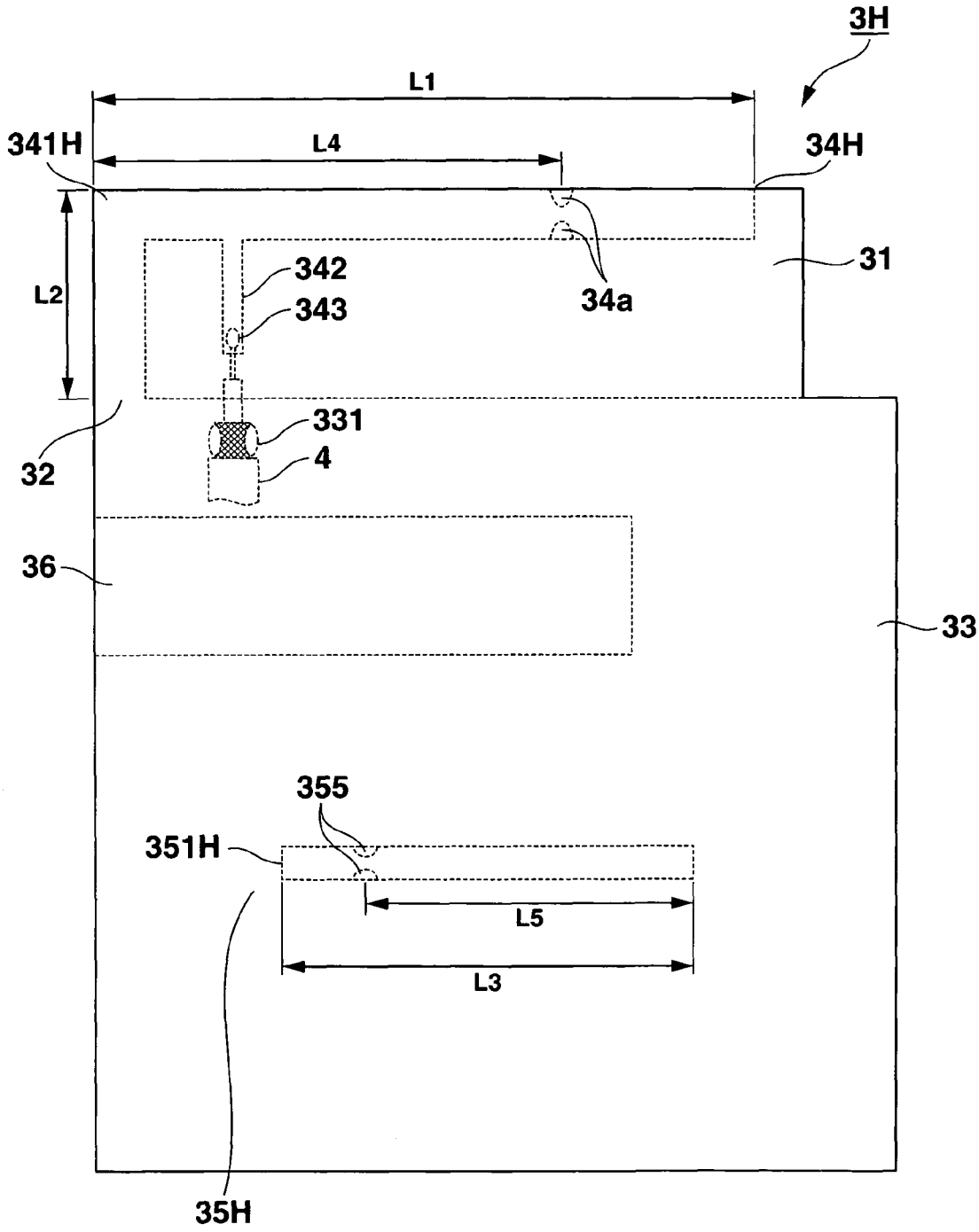
FIG. 14 is a plan view showing configuration of a plane circular polarization antenna 3H.

A fifth modification of the above embodiment will be described with reference to FIG. 14. FIG. 14 is a plan view showing planar configuration of a plane circular polarization antenna 3H.

As shown in FIG. 14, the plane circular polarization antenna 3H of the present modification includes an inverted F antenna 34H and a slot antenna 35H instead of the inverted F antenna 34 and slot antenna 35 of the plane circular polarization antenna 3. The inverted F antenna 34 includes an L-shaped portion 341H and the projection 342. The L-shaped portion 341H includes marks 34*a*. The marks 34*a* are marks provided on the longer side of the L-shaped portion 341H which is made of a conductor. The longitudinal and latitudinal lengths of the L-shaped portion 341H are L1 and L2, respectively. The length between the marks 34*a* and a crossing of the rectangular portions of the L-shaped portion 341H is defined by L4.

The slot antenna 35H includes facing projections 355 in the slot 351H. The longitudinal length of the slot 351H is defined by L3. The length between one end of the slot 351H and the projections 355 is defined by L5.

According to a certain standard, a frequency band of 2.45 GHz is used for wireless LAN communication. One-fourth of the wavelength of the radio wave in the frequency band corresponds to the length of (L1+L2). If the reduction effect due to a dielectric constant of the supporter attached to the slot is not considered, one-fourth of the wavelength of a radio wave of the 2.4 GHz band corresponds to the length L3 of the slot 351H.

According to another standard, a frequency band of 5.2 GHz is used for wireless LAN communication. One-fourth of the wavelength of the radio wave corresponds to the length of (L4+L2). One-fourth of the wavelength of a radio wave of the 5.2 GHz band corresponds to the length L5.

Thus, to use the plane circular polarization antenna 3H at wavelength of a radio wave of the 2.45 GHz band, the plane circular polarization antenna 3H is used as it is. Radiation and reception of a radio wave of the 2.45 GHz band are enabled by the plane circular polarization antenna 3H. In contrast, to use the plane circular polarization antenna 3H at wavelength of a radio wave of the 5.2 GHz band, the L-shaped portion 341H is cut out at the marks 34*a*, the cutout portion is removed, and the projections 355 of the slot 351H are short-circuited by soldering. Radiation and reception of a radio wave of the 5.2 GHz band are enabled by thus processed plane circular polarization antenna 3H.

Depending on the frequency band of the radio wave used, it is possible to cut out the L-shaped portion 341H at the marks 34*a* and not to solder the projections 355, alternatively, it is possible not to cut out the L-shaped portion at the marks 34*a* and to solder the projections 355.

As described above, the present modification produces similar effects to the above embodiment. Moreover, the plane circular polarization antenna 3H can be easily reshaped to appropriate form.

The above description of the embodiment and modifications refers to examples of the plane circular polarization antenna and an electronic apparatus according to the present invention. The present invention is not limited to the above description.

In the above-described embodiment and modifications, the base film 31 is attached to one surface of the slot of the slot antenna, whereas the supporter 6 which is dielectric is attached to the other surface of the slot. However, the present invention is not limited to this. For example, the dielectric may be attached to the slot so as to cover both surfaces of the slot. Alternatively, dielectric may have a protrusion corresponding to the slot and fitted into the slot so as to fill the slot with the dielectric.

It should be noted that arbitrary changes may be made in detail to the configuration and operation of components of the plane circular polarization antenna 3 and portable terminal 100 according to the above-described embodiment, without departing from the spirit and scope of the present invention.

What is claimed is:

1. A plane circular polarization antenna comprising:
a flat insulating substrate; and
a flat conductor provided on the flat insulating substrate,
wherein the flat conductor comprises:
an inverted F antenna including a feeding point; and
a ground portion,
wherein the ground portion comprises:
a slot antenna including a slot; and
a short-circuiting portion provided in a part of an area between the inverted F antenna and the slot antenna, and
wherein the short-circuiting portion is short-circuited to a frame ground by contacting a conductive gasket which is electrically connected to the frame ground.

2. The plane circular polarization antenna according to claim 1, wherein at least one surface of the slot in the slot antenna is covered with a dielectric material.

3. The plane circular polarization antenna according to claim 1, wherein a length of one side of the ground portion is longer than one-fourth of a wavelength of a radio wave to be communicated.

4. The plane circular polarization antenna according to claim 1, wherein the slot is rectangular-shaped.

5. The plane circular polarization antenna according to claim 1, wherein a shape of the slot includes a corrugated-shape or a crank-shape.

6. An electronic apparatus comprising:
the plane circular polarization antenna according to claim 1; and
a controller configured to control communication via the plane circular polarization antenna.

7. The plane circular polarization antenna according to claim 1, wherein the conductive gasket is formed of a rectangular elastic insulating material surrounded by a conductive mesh.

8. A plane circular polarization antenna comprising:
a flat insulating substrate; and
a flat conductor provided on the flat insulating substrate,
wherein the flat conductor comprises:
an inverted F antenna including a feeding point; and
a ground portion,
wherein the ground portion comprises:
a slot antenna including a slot; and
a short-circuiting portion provided in a part of an area between the inverted F antenna and the slot antenna, and
wherein the short-circuiting portion is short-circuited to a frame ground by contacting one of a spacer and a rib of a frame having the frame ground.

* * * * *